US007434665B2

(12) United States Patent
Bahjat et al.

(10) Patent No.: US 7,434,665 B2
(45) Date of Patent: Oct. 14, 2008

(54) ELEVATOR DOWN PEAK SECTORING WITH LONG CALL RESPONSE

(75) Inventors: Zuhair S. Bahjat, Farmington, CT (US); Theresa M. Christy, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 539 days.

(21) Appl. No.: 10/555,531

(22) PCT Filed: Jul. 21, 2003

(86) PCT No.: PCT/US03/22673

§ 371 (c)(1),
(2), (4) Date: Nov. 4, 2005

(87) PCT Pub. No.: WO2005/016810

PCT Pub. Date: Feb. 24, 2005

(65) Prior Publication Data

US 2006/0249336 A1 Nov. 9, 2006

(51) Int. Cl.
*B66B 1/20* (2006.01)

(52) U.S. Cl. ..... 187/383; 187/247

(58) Field of Classification Search ..... 187/247, 187/248, 380, 382, 383, 385, 386, 387, 388
See application file for complete search history.

(56) References Cited

U.S. PATENT DOCUMENTS

| | | | | |
|---|---|---|---|---|
| 3,572,470 | A | 3/1971 | Hirsch et al. | |
| 3,645,361 | A | 2/1972 | Stichweh et al. | |
| 3,831,715 | A | 8/1974 | Matsuzawa et al. | |
| 4,804,069 | A | 2/1989 | Bittar et al. | |
| 4,836,336 | A | 6/1989 | Schroder | |
| 5,511,634 | A | 4/1996 | Bahjat et al. | |
| 5,955,708 | A * | 9/1999 | Amano et al. | 187/247 |
| 7,083,027 | B2 * | 8/2006 | Siikonen et al. | 187/383 |

OTHER PUBLICATIONS

PCT International Search Report for PCT/US03/022673, dated Mar. 16, 2004.
PCT International Preliminary Examination Report for PCT/US03/022673, dated Oct. 8, 2004.

* cited by examiner

*Primary Examiner*—Jonathan Salata

(57) ABSTRACT

In down peak, floors of the building are divided into sectors (38), empty cars (50) are assigned (63, 64) to the sector and assigned (65) the highest down call in the sector provided the highest down call is above the committable floor of any car already assigned in the sector, or there is no car assigned in the sector. If a car is not full (52), it will be assigned additional calls (56). If there are no calls in the sector below a car sector which is not full, a long calls routine (67) determines if there is a down call (75), that is in danger of becoming a long-waiting call, ahead of a car (69) and if so, assigns that call to the car (76).

2 Claims, 3 Drawing Sheets

ELEVATOR DOWN PEAK SECTORING WITH LONG CALL RESPONSE

TECHNICAL FIELD

This invention relates to assigning elevator cars during down peak to sectors, cars serving calls in an assigned sector, additional cars being assigned to the sector when needed, cars with unused capacity responding to calls outside the assigned sector which have been waiting for a long time.

BACKGROUND ART

Down peak traffic occurs in a building when a significant percentage of the people in the building all want to travel down to the lobby at the same time. This occurs often in office buildings at lunchtime or at the end of the work day when people are anxious to leave their offices and head home. It can also occur in residential buildings at the start of the day when people are leaving their homes to go to work, or in hotels when many people are heading to the lobby near check-out time.

Most multi-car elevator systems have an up peak mode which is relatively easy to handle, since all of the calls being handled as up-peak calls originate from the lobby floor. In contrast, during down peak, the calls originate on any floor of the building, and only terminate at a common floor.

Traditional means of handling down peak traffic in a building involves dispatching cars in such a way that empty cars travel to the highest floors with demand, answer the demand at successive floors and then carry those passengers to the lobby. What often happens, however, is that the elevator cars become full at the higher floors and are forced to bypass passengers waiting for service at lower floors. This can lead to unacceptably long waits for those at the lower floors.

There have been some attempts at down peak sectoring, i.e., dividing the hoistway into groups of floors and serving those groups in some type of ordered fashion to prevent any set of floors, such as the lower ones, from being starved of service. When cars only serve the demand in the sector that they are assigned to, however, it can lead to excess capacity in a car that is not being utilized. For example, if a car serves a sector that includes floors 5, 6 and 7 but there are only a few passengers waiting for service in that sector, it may travel all the way to the lobby without considering passengers on floors 2, 3 or 4 who have been waiting for service. If the demand for service on those floors is very heavy, then the car assigned to that sector may not be able to keep up with the demand.

DISCLOSURE OF THE INVENTION

Objects of the invention include: an effective way to serve calls during down peak without calls at the lower ends of the sectors having to wait excessively long times due to assigned cars being full before reaching such calls, and without heavy traffic at some particular floors causing excessively long waits; and improved elevator dispatching during down peak.

According to the present invention, at the onset of heavy down traffic, called down peak, the floors of the building are assigned in groups called sectors, cars having no further calls to answer within an assigned sector can look in other sectors for calls that are likely to become long waiting calls, and additional cars being capable of assignment to a sector, when the traffic in that sector justifies it.

The invention combines the benefits of sectoring while considering calls in other sectors that have been waiting for a long enough time that they are in danger of becoming unacceptably long calls. The invention also provides for assignment of additional cars to a sector if the demand justifies it, thus serving both calls above sector cars and calls below a sector.

This invention provides balanced service to passengers on all floors of the building requiring transportation down to the lobby, by fully utilizing elevator capacity. In general, the invention causes each car to serve the sector of the hoistway to which it is assigned but also to examine other sectors for calls that are in danger of becoming unacceptably long; if there are such calls and if the car has extra capacity, then the car will be assigned to serve one or more of the calls in danger of becoming unacceptably long, even if that call is in a sector being served by another car; if there are calls above the car serving a sector, another car may be assigned thereto.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
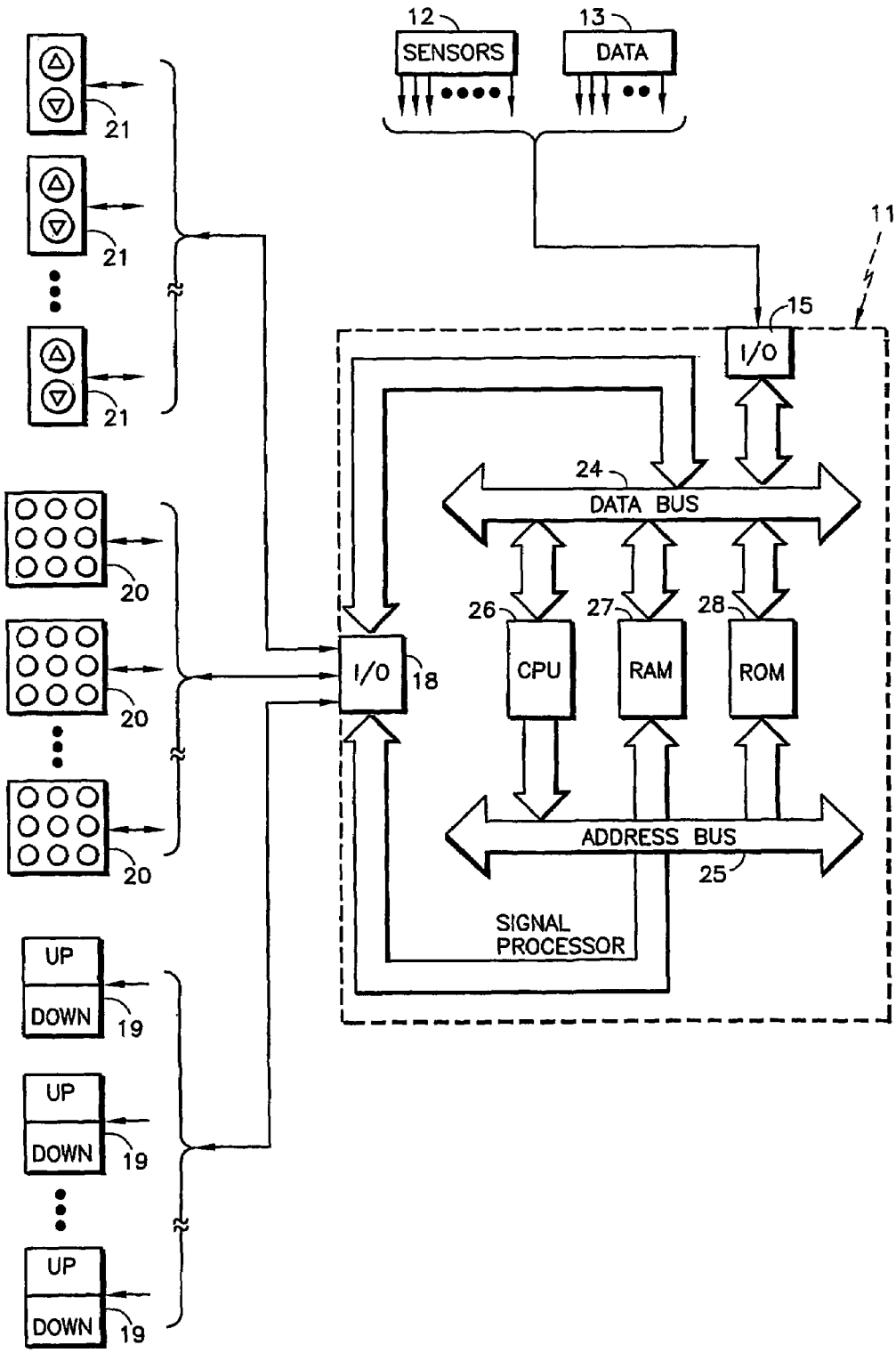
FIG. 1 is a schematic diagram of a conventional computer arrangement interfacing with elevators, as an example of a system in which the present invention may be practiced.

Referring to FIG. 1, a signal processor 11 is illustrative of group controllers that may allocate cars to respond to hall calls, utilizing aspects of the present invention. The processor 11 is responsive to a plurality of sensors 12, such as car weight sensors, and data signals 13, such as car direction and door condition, provided to an input/output (I/O) port 15 of the processor 11. Similarly, another I/O port 18 is connected to a plurality of hall call buttons 19 resident on the various floors of the building, a plurality of car call button panels 20, one resident in each car, and a plurality of hall lanterns 21, of which there are typically one or more at each floor landing. The processor 11 includes a data bus 24, an address bus 25, a central processing unit (CPU) 26, a random access memory (RAM) 27, a flash memory (not shown), and a read only memory (ROM) 28 for storing the requisite elements of programs or routines that can carry out the present invention.

Figure 2:
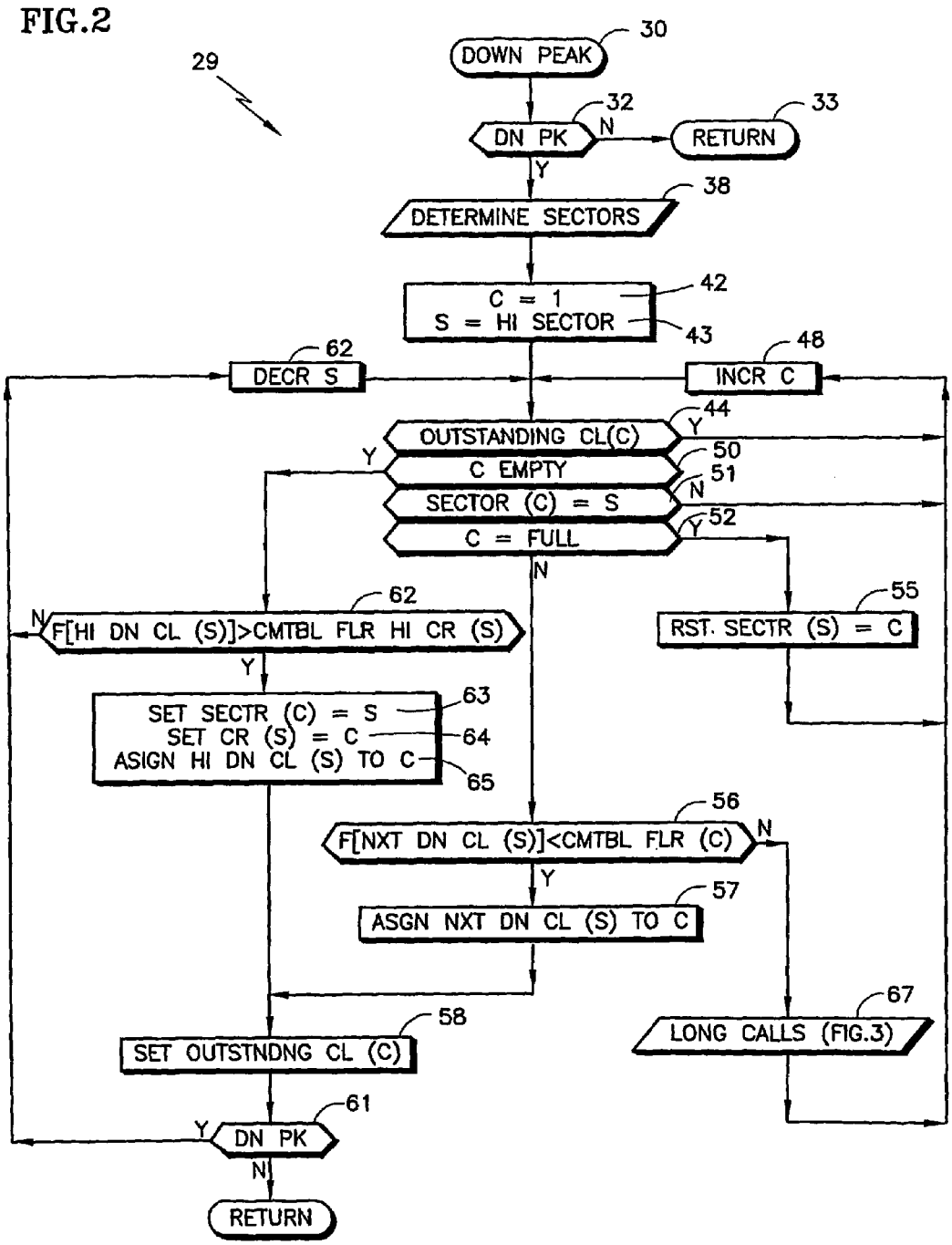
FIG. 2 is a simplified logic flow diagram which is exemplary of processes that may be utilized to practice down peak sectoring of the present invention.

A simplified expression of a routine for carrying out the present invention is set forth in FIG. 2. Therein, a down peak dispatching routine 29 is reached through an entry point 30 and a test 32 determines if traffic in the down direction has reached the down peak magnitude, or not, which is determined in a conventional way. If not, other parts of the program are reverted to through a return point 33.

If down peak is underway, an affirmative result of test 32 reaches a subroutine 38 which will determine the sectors in any one of a variety of ways, all of which are conventional. The easiest way to group floors is to do so based on the number of cars in the group and the number of floors in the hoistway. When this method of determining sectors is used, one elevator car will be assigned to each of the sectors and a remaining "free" car will be used to serve counterflow traffic or to help out wherever traffic is heaviest.

In a different method of defining sectors, the building population is the main component of the sectoring and the goal is to have approximately equal numbers of people in each sector. One car is kept free to serve counterflow traffic or to help out the assigned sector cars in areas of heaviest demand. In this method, each sector may have a different number of floors in it, depending on building population.

The basis of determining the sectors may be the number of people left on each floor, as determined by keeping track of how many people have left, then it may be desirable to change the sectoring based on how many people are left on each floor since this will change as people start to leave, herein called dynamic sectoring in which the sectoring is periodically recalculated by the group controller based on the number of people left per floor.

Once the sectors have been determined by the group control software, the sectors will be used to determine which cars should be assigned to which hall calls. Then a car pointer, C, is set to ONE in a step 42 and a sector point, S, is set equal to the highest sector in a step 43. In order to determine if a car has excess capacity, it is necessary to wait until it has answered a call assigned to it before it can be determined whether or not it has become full. For this purpose, there is an outstanding call flag which may be set for each car, as described below. When car C has an assigned call that has not yet been answered, a test 44 will be affirmative, so that no call assignments will occur. With respect to any given car, the routine may process that car through step 44 many, many times after assigning a call to the car and before the outstanding call flag for that car is reset.

An affirmative result of test 44 reaches a step 48 to increment the car pointer, modulo the number of cars assigned to sectors; in that way, each car is continually treated in turn, and test 44 is reached once again to determine if the next car in turn has an outstanding call. Assuming that it has not, a test 50 determines if car C is empty. If it is not empty, it is not available to be newly assigned to this sector, but a test 51 may determine that it has previously been assigned to this sector, and may respond to another call in its assigned sector, provided it is not already full as determined by a test 52. If car C is full, an affirmative result of test 52 reaches a step 55 to reset the assignment of car C to sector S, such assignment being described hereinafter. Then step 48 is again reached to increment C, thereby pointing to the next car in turn.

In the routine of FIG. 2, it is assumed that floors are poled from top to bottom, so each call is assigned in a high to low sequence.

Assume the car under consideration, C, has no outstanding call, is not empty, is assigned to the current sector, and is not full. A negative result of test 52 will reach a test 56 to determine if the floor of the next successive down hall call in sector S is below the committable floor of car C. If it is, a step 57 will assign the next down call of sector S to car C, and then a step 58 will set a flag indicating an outstanding call for car C, so that car C will not be considered for any further service until it has answered that call and the then current capacity of the car can be determined.

Then a test 61 determines if down peak is still in process, or not. Initially, it will be, so a positive result of test 61 will reach a step 62 to decrement the sector pointer, modulo the number of sectors in the building. Then, the car currently identified by the car pointer, C, will be examined with respect to this sector. In the example here, car C has just had a call assigned to it so that test 44 will be affirmative reaching step 48 to increment the car pointer.

Assume now that the car indicated by the car pointer, C, is empty. It won't have an outstanding call so test 44 is negative but test 50 will be affirmative reaching a test 62. In test 62, the floor number of the highest outstanding down call in sector S is compared with the committable floor for whatever is designated as the high car assigned to sector S. If there is no assigned car in sector S, then there is no highest assigned car in sector S. In this case, the committable floor for high car of S is set equal to zero, so that test 62 will automatically be affirmative. On the other hand, if there is a car serving sector S, and no additional car has been assigned to sector S thereafter, then such car will have been designated as the high car in sector S as described below. If there are any calls in the sector which are behind the previously assigned car, test 62 will be affirmative.

If there is a call above the high car in this sector, or if there is no car in this sector, an affirmative result of test 62 reaches a step 63 to set the assignment of car C to sector S, and to set the high car in this sector to car C in a step 64. Then, a step 65 will assign the highest down call in sector S to car C and the step 58 will set the outstanding call flag for car C. The test 60 is reached to see if down peak is still in process. If it is, the step 61 is reached to decrement the sector pointer, and the next sector in turn will be tested as against whatever car is being pointed to by the car pointer, C.

Assume that car C does not have an outstanding call, is not empty and is assigned to this sector so that test 52 is reached. Assume also that car C is not full, and therefore has excess capacity. Next assume that there are no high down calls in the sector which are below the committable floor of car C. Another aspect of the invention is that car C can now look for any calls that may be in danger of having been outstanding for an excessive period of time. A negative result of test 56 reaches a long call's subroutine 67, illustrated in FIG. 3.

Figure 3:
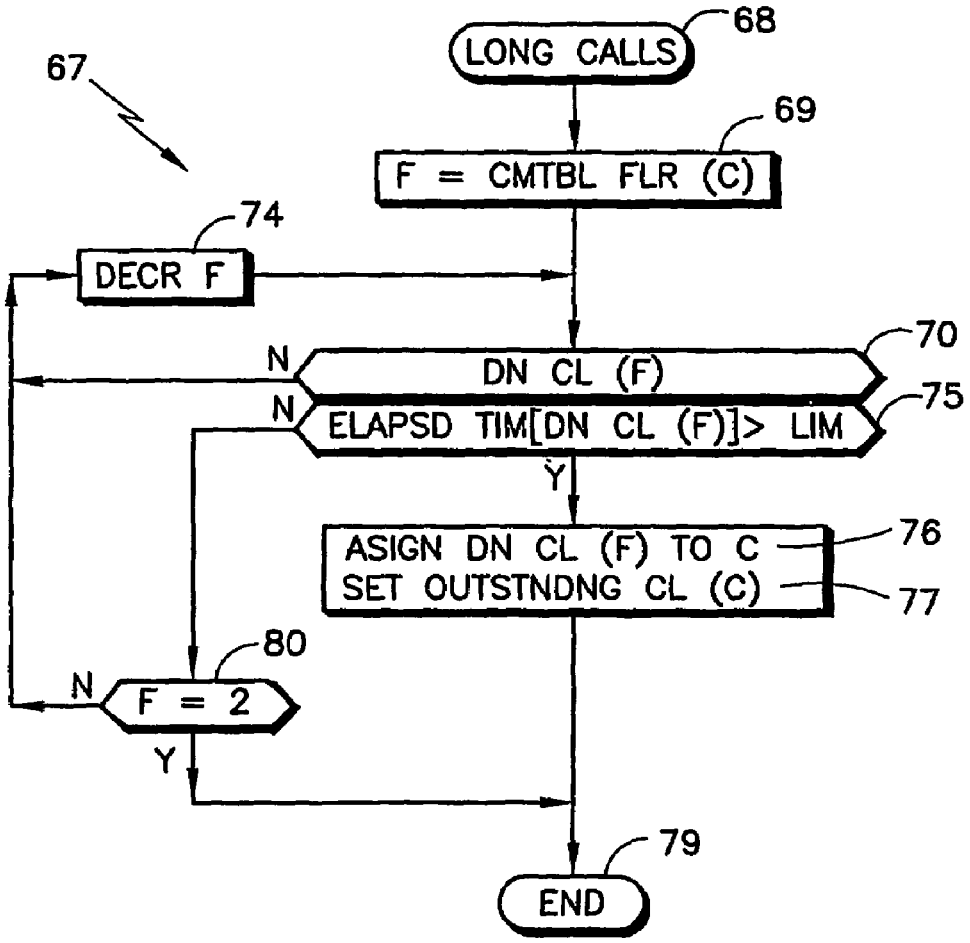
FIG. 3 is a simplified logic flow diagram which is exemplary of processes that may be utilized to practice long call assignments of the present invention.

In FIG. 3, the long call's subroutine is reached through an entry point 68 and a step 69 sets a floor pointer, F, to the committable floor of car C. A test 70 determines if there is a down call for floor F. If not, a negative result of test 70 reaches a step 74 to decrement the F pointer. Then, test 70 is repeated. If there is a down call at floor F, a test 75 determines if the elapsed time of the down call at floor F exceeds a call waiting time limit, which may take into account a reasonable amount of time for the elevator to reach a call, which may, on average, be on the order of one minute or so. In fact, this is a settable limit which may be adjusted depending upon current traffic density (calls per minute) which is easily monitored in ways that are well known in the art. If the call at floor F is in danger of becoming an excessively long-waiting call, an affirmative result of test 75 reaches a step 76 which assigns the down call at floor F to car C, and a step 77 which sets the outstanding call flag for car C. And then the routine ends at a point 79, causing the routine of FIG. 2 to be resumed at step 48 to increment the car pointer.

If the call at floor F is not in danger of becoming an excessively long-waiting call, a negative result of test 75 will reach a test 80 to determine if all of the floors below the committable floor of car C have been examined for a long call. If they all have not been examined, a negative result of test 80 reaches the step 74 to decrement F, and the process is repeated for the next floor in turn.

To assist in the routine of FIG. 2, any outstanding call flag will be reset when a car leaves a landing, for instance, when the car is given the run command. Whenever a car approaches the lobby, if any high car (S) is set to C, that will be reset to zero (meaning no car). Also, if the sector (C) is equal to some sector number, it too is reset to zero.

If parallel processing is not available, the routine of FIG. 2 can be passed through every so often, and other programming could be reverted to prior to reaching either or both of the increment steps 48, 61. Or, other suitable accommodation can be made in a manner which is conventional and within the skill of the art.

The invention claimed is:

1. A method of assigning elevator calls (21) to cars during down peak traffic conditions, comprising:

dividing (38) all the floors in the building into sectors;

if there is (62) at least one pending down hall call in a sector, assigning (65) that call to an empty car, said car then being assigned (63) to that sector;

assigning (57) to any particular car which is not full (52) and which is assigned (51) to a particular sector, down calls in said particular sector ahead of said particular car (56);

characterized by:

if there are no pending down calls in a specific sector (56) ahead of a specific car which is not full and which is assigned to said specific sector, determining (70) if there is at least one down hall call outside of said specific sector which has been waiting for more than a predetermined time limit (75) and which is ahead (69) of said specific car, and if so, assigning such call to said specific car (76).

2. A method of assigning elevator calls (21) to cars during down peak traffic conditions, comprising:

dividing (38) all the floors in the building into sectors;

if there is (62) at least one pending down hall call in a sector, assigning (65) that call to an empty car, said car then being assigned (63) to that sector;

assigning (57) to any particular car which is not full (52) and which is assigned (51) to a particular sector, down calls in said particular sector ahead of said particular car (56);

characterized by:

determining (62) if there is a down call in a given sector that is at a floor higher than the committable floor of the highest car assigned to said given sector, and if so, assigning (65) that call to another car and assigning (63) said another car to said sector.

* * * * *